US005437408A

United States Patent [19]

Chesnut

[11] Patent Number: 5,437,408

[45] Date of Patent: Aug. 1, 1995

[54] ANIMAL COIN BANK

[76] Inventor: John M. Chesnut, P.O. Box 795, Grantham, N.H. 03753

[21] Appl. No.: 146,659

[22] Filed: Nov. 2, 1993

[51] Int. Cl.[6] ..... G07F 1/04

[52] U.S. Cl. ..... 232/4 R; 194/344; 194/352; 446/168; D99/38

[58] Field of Search ..... 232/4 R, 5, 9, 14, 44, 232/55; 193/DIG. 1, 2 R, 27; 459/5, 9; 446/8, 9, 10, 11, 12, 13, 168; 194/344, 352; D99/38

[56] References Cited

U.S. PATENT DOCUMENTS

| | | | |
|---|---|---|---|
| D. 251,323 | 3/1979 | Phipps | D99/35 |
| D. 291,938 | 9/1987 | Kauffmann | D99/40 |
| 301,169 | 7/1884 | Small | 232/9 |
| 433,736 | 8/1890 | Lockwood . | |
| 438,832 | 10/1890 | Anderson | 232/9 |
| 517,071 | 3/1894 | Russell . | |
| 745,707 | 12/1903 | Woodward | 194/344 |
| 812,327 | 2/1906 | Cranner | 194/344 |
| 917,629 | 4/1909 | Long | 194/344 |
| 932,403 | 8/1909 | Long | 194/344 |
| 1,029,209 | 6/1912 | Mills | 194/344 |
| 1,546,484 | 6/1925 | Punzak | 232/5 |
| 2,563,608 | 8/1951 | Laufer | 273/109 |
| 2,629,546 | 2/1953 | Van Lahr | 232/9 |
| 2,749,656 | 5/1955 | Reynolds | 46/4 |
| 3,002,313 | 10/1961 | Hutchison | 46/3 |
| 3,218,754 | 11/1965 | Hunter | 46/2 |
| 4,297,807 | 11/1981 | Buettner | 46/4 |
| 4,762,512 | 8/1988 | Divnick | 446/8 |
| 4,787,873 | 11/1988 | Divnick | 446/8 |
| 5,046,989 | 9/1991 | Dass | 194/344 |
| 5,112,264 | 5/1992 | Ning et al. | 446/108 |
| 5,176,238 | 1/1993 | Deglau | 194/338 |
| 5,181,881 | 1/1993 | Abe | 194/344 |

FOREIGN PATENT DOCUMENTS

| | | | |
|---|---|---|---|
| 469405 | 11/1928 | Germany | 232/4 R |

*Primary Examiner*—Michael J. Milano
*Attorney, Agent, or Firm*—Michael J. Weins

[57] ABSTRACT

The present invention is for a bank which has a visible serpentine coin path through which coins are deposited into a coin reservoir. The serpentine coin path has a major slot for the transportation of the coins into the reservoir and at least one minor slot through which the coins can be viewed as they travel down the serpentine path to the reservoir. The slot and reservoir are particularly well suited for incorporation into an animal bank.

30 Claims, 5 Drawing Sheets

ANIMAL COIN BANK

FIELD OF INVENTION

The present invention relates to banks and more particularly to banks which have an extended viewable coin path connecting to a coin storage reservoir where the money accumulates. The viewable extended path is well suited for animal banks.

BACKGROUND OF THE INVENTION

There have been a variety of banks designed to provide an extended, viewable path along which coins travel before reaching a coin storage reservoir.

U.S. Pat. Nos. 433,736 and 4,762,512 provide banks which have viewable extended spiral paths along which the coins travel. Though these banks provide viewable coin paths, they do not provide for great flexibility in the design of the bank since the path has a substantial foot print and would not accommodate embedding in a structure such as an animal's neck.

U.S. Pat. No. 2,749,656 and U.S. Design Pat. No. 251,323 provide banks with extended coin paths where coins will tumble down the coin path, flipping end over end as they travel down the path. These paths again have a substantial foot print for the coin path.

U.S. Pat. No. 517,071 and U.S. Pat. No. 4,297,807 teach the use of zigzag paths where the coins roll on their rim down a series of ramps and are transferred from ramp to ramp by impacting a vertical wall and dropping to the track below. The coins are maintained in a vertical position by a front plate which is transparent. The coins are fed into the bank by rolling along one ramp and dropping onto a ramp below. These ramps are arranged to provide a slow lazy rolling motion.

U.S. Pat. No. 5,176,238 teaches the use of multiple paths providing alternative branches along which the coins travel and again uses a transparent front panel to secure the coins which travel along the path. The use of the multiple paths of the '238 patent as well as the paths of the '071 patent and the '807 patent results in an extended foot print for the path; they are not well suited for banks in which the coin path resides in restricted areas such as passing down the throat of an animal bank.

U.S. Pat. No. 3,002,313 provides a chime bank which will play one or more notes as the coin progresses along a path which leads to a coin storage reservoir. A series of ramps are provided with retaining walls for maintaining the coin on the ramps. At the end of the ramps are chimes which form vertical surfaces which, when impacted, provide a tone and reverse the direction of the coin. The slopes of the ramps disclosed are shallow and assure that the tones resulting from impact of the chimes are distinct and spatially separated so that a melody can be played. Maintaining the slopes shallow will also reduce the likelihood of derailment of the coins as they leave an upper ramp, impact the chime and engage a lower ramp.

While there have been numerous animal banks, such as disclosed in U.S. Design Pat. No. 291,938, these animal banks do not have a serpentine path into which coins are fed.

Thus, there is no teaching of a bank with an open serpentine path that will positively retain a coin in the track as it slides and rolls down an inclined path and there is no teaching of an animal coin bank having a serpentine coin path that will give the perception that the coin is being swallowed.

OBJECTS OF THE INVENTION

It is an object of the invention to provide a bank wherein the coins that are deposited can be seen moving along a serpentine path for substantially its entire trip from the point of entry to the coin reservoir of the bank.

It is another object of the invention to provide a bank having a coin path with a large vertical component which does not employ a front panel to maintain the money in the path.

It is yet another object to provide a bank where the money is visible along the entire path, providing the perception that the money is sliding down the path.

It is still a further object of the invention to provide a see-through visible path, the path being blocked by the coin rolling down it, highlighting the coin's position as it progresses down the path.

It is another object to provide a bank that has a coin path that can be configured to the shape of an animal.

It is a further object of the invention to provide a bank that will encourage charitable contributions.

It is still a further object of the invention that the coins, once deposited, will not readily be removed by shaking the bank.

These and other objects of the invention will be readily apparent from the following description, drawings and claims.

SUMMARY OF THE INVENTION

The present invention, in its simplest form, provides a coin bank having a bank body with a coin reservoir in which coins are stored and a substantially vertical viewable serpentine coin path along which the coins travel. A serpentine path, for the purpose of this patent, describes a path which will be substantially planar. Such a path can be formed from arcs and straight lines and can be visualized as a snake slithering along the ground.

The serpentine coin path has a major slot having a front, a back, and side surfaces, with a major slot centerline defining a major serpentine slot down which coins will roll/fall. The serpentine coin path also has at least one minor slot which intersects the major slot and provides viewing of the serpentine coin path.

The major slot has a cross section with a width W and a depth D. The at least one minor slot having an open front, an open back, and side surfaces which are closed, has a cross section with a width w and a depth d and a minor slot centerline defining a view path. The paths are so positioned that the major slot centerline and the minor slot centerline are parallel and define a surface which is parallel to the side surfaces of the major slot and the minor slot and midway therebetween.

The path of the major slot is constructed such that it will maintain coins in a substantially vertical position as they roll/fall down the major slot. The coin path configuration is critical if the coin is to pass freely through the major slot without being derailed and either falling out of the serpentine coin path or becoming lodged in the serpentine coin path. The preferred geometry of the serpentine coin path is defined by the major slot having a minimum width W of greater than about fifteen-sixteenths (15/16) of an inch to assure that a quarter will pass down the major slot. Similarly, the major slot should have a minimum depth D greater than about one-sixteenth (1/16) of an inch to assure the passage of a nickel.

To assure coins are maintained in the major slot as they roll/fall down the major slot, the major slot should have a width W not greater than about one (1) inch and the major slot depth D should be limited to about one-eighth ($\frac{1}{8}$) of an inch, when the width w of the minor slot is maintained not greater than about three-eighths ($\frac{3}{8}$) of an inch. With these limitations, a coin will be maintained in the major slot and jamming of the serpentine coin path will be avoided. As the width w of the minor slot is reduced, the major slot width W can be increased by one half the decrease in w. Thus, in the most general case, W will be not greater than (13/16−w/2).

It is also preferred that w always be greater than about one-eights (1/80 inch so that coins can be readily seen as they travel down the serpentine coin path.

While the slots discussed above, and particularly the major slot are generally rectangular, in some cases, the use of a major slot with a rectangular cross section is not practical when the slot is to be formed by molding techniques. When a molded slot is to be made, draft must be provided to the pattern so it can be withdrawn, in which case, the draft λ should be limited to less than about 10°. When such draft is provided, the maximum width of the minor slot should be reduced to about one-fourth ($\frac{1}{4}$) of an inch.

It is also further preferred that to provide a substantial fall time for the coin, the substantially vertical viewable serpentine coin path should have a height H of at least about twelve (12) inches.

A bank having the improvements discussed above is particularly well suited for animal banks, and more particularly for animals which have long appendages which can assume a vertical position. Long-necked animals such as ducks, geese, giraffes, ostriches, and dinosaurs are particularly well suited for such banks. However, other types of animals can be adapted to embody the present invention; these animals include elephants with a raised trunk to serve as the substantially vertical appendage, or a seal balancing a pole on its nose where the pole serves as the substantially vertical appendage.

In an animal having a body and a neck when the neck length is large compared to the body height, the neck will naturally accommodate the serpentine coin path which is substantially vertical. Such animals are preferred since the path can be included without requiring a distortion of the animal. In the animal banks, the coin reservoir can be integrated into the animal motif as an extended stomach.

In one preferred embodiment, the bank will be an animal having a head with a mouth into which the coin is fed. A neck is provided having a first side and a second side which attaches to the head and to a body which contains the coin reservoir. The serpentine coin path runs from the mouth, through the neck, and exits into the coin reservoir which forms an extended stomach for the animal. The neck of the animal is substantially vertical to accommodate the substantially vertical viewable serpentine coin path. When a single minor slot is employed, it will reside in either the first side of the neck or the second side of the neck. While the major slot must form a continuous path between the coin input location and the coin reservoir, the minor slot need not be continuous. However, the minor slot should provide slot segments of substantial length so that the progress of the coin down the path can be observed. If the minor slot is not nearly continuous, then the view of the coin as it travels down serpentine coin path will be blocked for a substantial portion of its travel so the length of the minor slot is less than about 80% of the length of the major slot, attention to the coin as it travels down the path may wane.

When a second minor slot is employed, the first minor slot resides in the first neck side while the second minor slot resides in the second neck side. When two minor slots are employed, it is further preferred that one of the minor slots be discontinuous to provide additional structural rigidity to the neck of the animal.

It is further preferred that a base be attached to the body of the bank and that the base be contoured in the form of feet for the animal. It is also preferred that the body and in particular the neck section be less than about one (1) inch in thickness and that the bank have an extended stomach which can be fashioned from a bulb which serves as the coin reservoir. It is still further preferred that the bulb be transparent to allow viewing of the coins. This is particularity advantageous when the bank is being used to collect for charity since it provides a visual display as to the growth of the funds.

BEST MODE OF CARRYING THE INVENTION INTO PRACTICE

Figure 1:
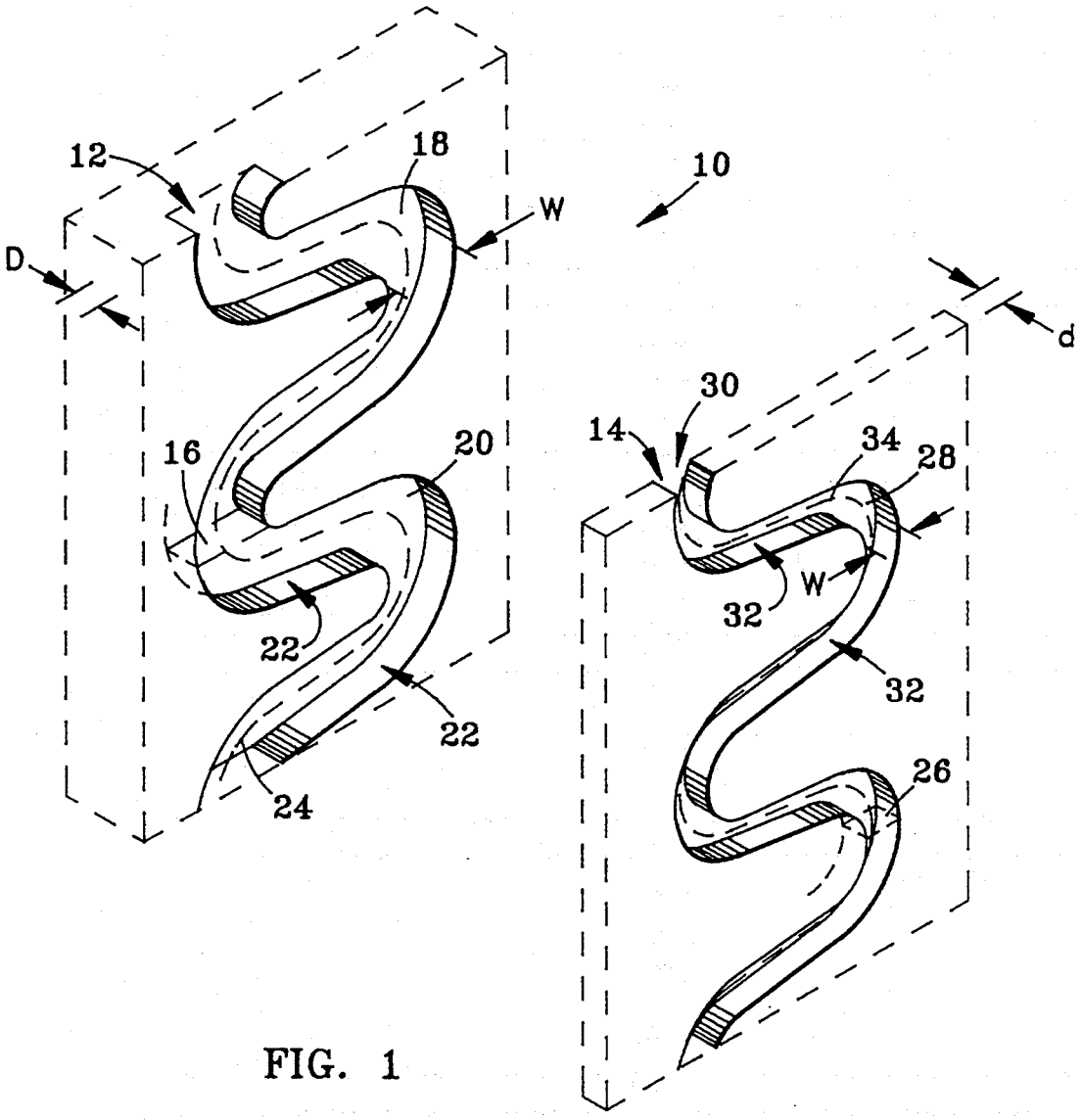
FIG. 1 is an exploded isometric view of a section of a serpentine coin path of the present invention illustrating the spatial relationship between a major slot and a minor slot employed in the present invention.

FIG. 1 is an exploded isometric view of a segment of a serpentine coin path 10 employed in the banks of the present invention. The serpentine coin path 10 has a major slot 12 and minor slot 14. The major slot 12 has a major cross section 16 which is rectangular. The major slot 12 has a front 18 which is open and is overlaid in part by the minor slot 14 which intersects the major slot 12. The minor slot 14 restricts the open front 18 of the major coin slot 12 and will maintain a coin traveling down the substantially serpentine vertical viewable path 10 within the confines of the major slot 12. The major slot 12, as illustrated, has a back surface 20 which is solid. Thus, viewing a coin traveling down the major slot 12 is limited to viewing from the front of the serpentine coin path 10. Side surfaces 22 are separated by a distance W which defines the width of the major slot 12 and is defined as the perpendicular distance between the side surfaces 22. The side surfaces 22 have a depth D and form the ends of the major cross section 16 of the major slot 12. A major slot centerline 24 passes through the center of the major rectangular cross section 16 of the major slot 12.

The exploded view of FIG. 1 also shows a segment of the minor slot 14. The minor slot 14 has a minor cross section 26 having a width w and a depth d. The minor slot 14 has an open front 28 and an open back 30 and is bounded by side surfaces 32. A minor slot centerline 34 passes through the center of the minor cross section 26 of the minor slot 14. In order for the major slot 12 and the minor slot 14 to cooperate, direct a coin down the major slot 12 and simultaneously allow coins to be viewed through the minor slot 14, the minor slot 14 must be properly sized and positioned. Viewing will be enhanced by maximizing the width w of the minor slot 14 and optimizing the relative position of the major slot 12 with respect to the minor slot 14. The minor slot 14 should be centered with respect to the major slot 12 and have the same period as the major slot 12. These conditions will be met if the major slot centerline 24 and the minor slot centerline 34 are parallel and a surface containing these lines is midway between the side surfaces 22 of the major slot 12 and the side surfaces 32 of the minor slot 14.

To maintain a back-and-forth action for the coin, it is necessary that a line of sight down the major slot 12 be less than about five-eighths ($\frac{5}{8}$) of an inch (the diameter of a dime). The actual line of sight may actually exceed this value over extended portions of the slot since the serpentine coin path over the region where the line of sight is less than five-eighths ($\frac{5}{8}$) inches will provide a horizontal component of the velocity that will assist the coin in passing over the line of sight in regions where the five-eighths ($\frac{5}{8}$) inches limit is exceeded. For serpentine paths where the width W of the major slot 12 is limited to assure constraint in the major slot 12 [W is less than (13/16−w/2) inches, where w is the width of the minor slot 14] and where there is significant curvature in the path there will not be a line of sight down the major slot 12. The configuration illustrated in FIG. 1 has no line of sight associated with the major slot 12.

Figure 2:
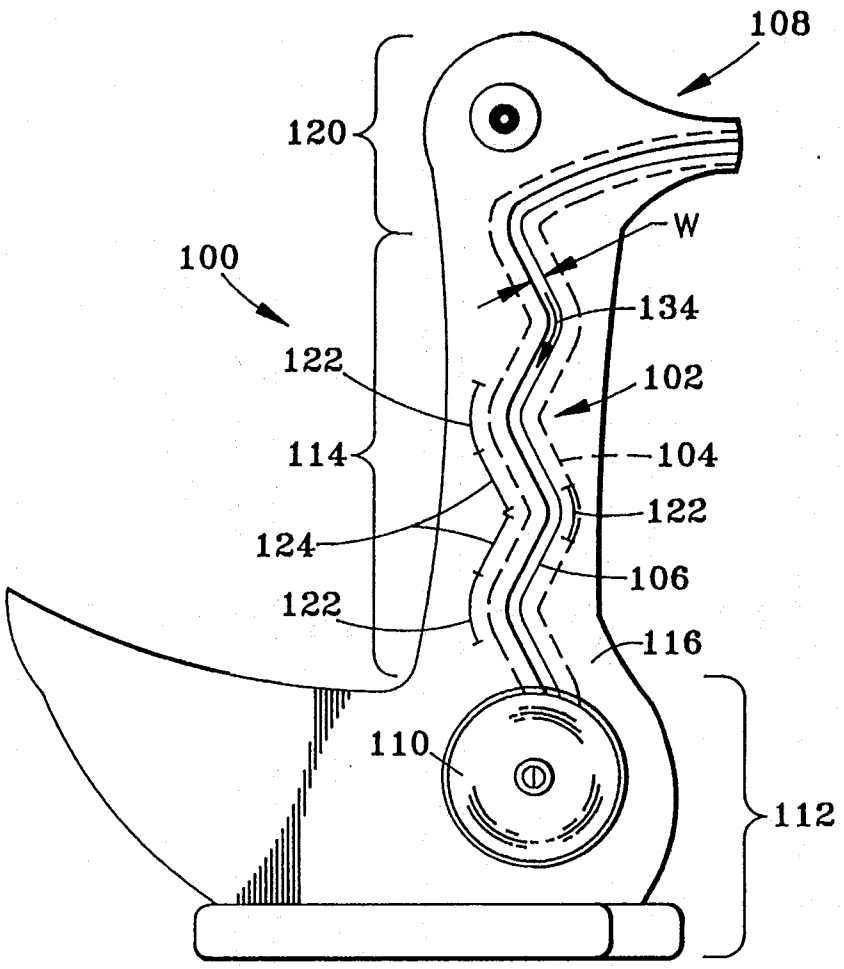
FIG. 2 is a side elevation view of a duck bank employing the serpentine coin path of the present invention and shows the character of the serpentine coin path which is constructed from an array of straight sections of uniform cross section which are joined with curved sections having the same cross section. The arrangement of the sections is such that there is a limited line of sight along a substantial portion of the serpentine coin path. The duck bank of FIG. 2 employs a single minor slot.

FIG. 2 is a side plan view of a bank having a bank body in the form of a duck which will be referred to as a duck bank 100. The duck bank 100 has a serpentine coin path 102 which has a major slot 104 and a minor slot 106. In the duck bank 100, coins are inserted through a beak 108 and pass down the serpentine coin path 102 which opens into a transparent coin reservoir 110 which forms an extended stomach of the duck bank 100.

Figure 3:
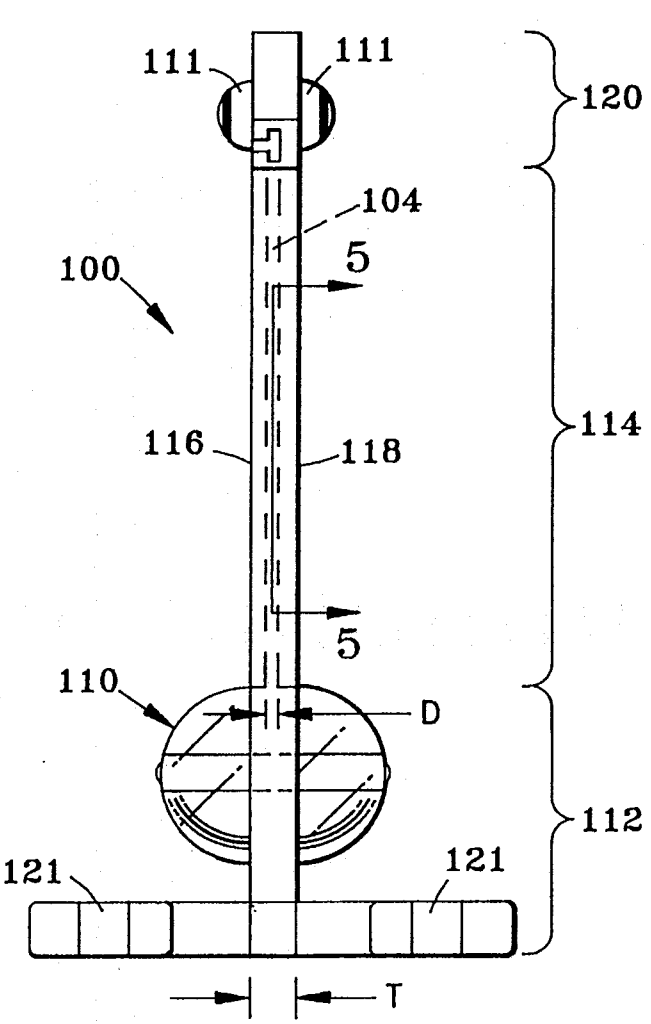
FIG. 3 is a front view of the duck bank of FIG. 2.
Figure 4:
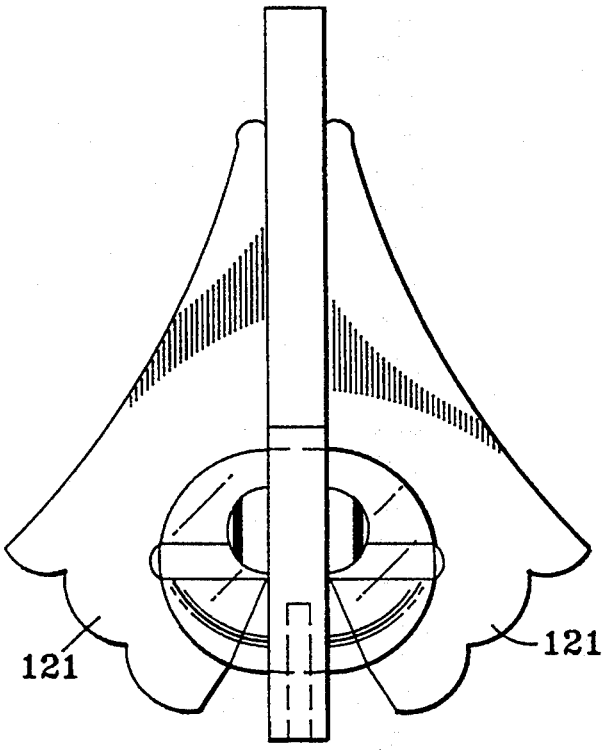
FIG. 4 is a top view of the duck bank of FIGS. 2 and 3.

FIG. 3 is a front view of the duck bank 100 shown in FIG. 2 and illustrating the planar character of the duck bank 100 when viewed from the front. The preferred thickness T of the planar character is less than about one (1) inch so that if the duck bank 100 is to be viewed from a skewed angle, the view of coins traveling down the serpentine coin path 102 will not be attenuated. Relief from the planar character is provided by the coin reservoir 110, which forms the extended stomach, and the bulging eyes 111. Neither the coin reservoir 110 nor the bulging eyes 111 effect the viewability of the coin as it falls down the serpentine coin path 102. While the major slot 104 which forms part of the serpentine coin path 102 has a serpentine profile in the side view of the duck bank 100, it is planar when viewed from the front of the duck bank 100. Similarly, the duck bank 100 has a body 112 which is planar when viewed from the front. A neck 114 having a first side 116 and a second side 118 loins the body 112. The neck 114 also loins a head 120 which includes the beak 108. The duck bank 100 has feet 121 which are planar in character when viewed from the front and side and form a platform to support the duck bank 100. When the feet 121 are viewed from the top, as shown in FIG. 4, they have the webbed appearance of duck feet.

Referring again to FIG. 2 the side elevation view of the duck bank 100 illustrates that the viewable serpentine coin path 102 is substantially vertical, that the major slot 104 is internal to the body 112, that the minor slot 106 intersects the major slot 104, and that the first side 116 of the neck 114 allows coins passing down the major slot 104 to be viewed. A coin inserted through the beak 108 and passing down the serpentine coin path 102 will remain engaged in the major slot 104 since the minor slot 106 will provide guidance as the coin progresses down the serpentine coin path 102. Yet while the minor slot 106 provides guidance to coins passing down the serpentine coin path 102, the coins can be viewed through the minor slot 106.

As can be seen from the side view shown in FIG. 2, the serpentine coin path 102 for the duck bank 100 is composed of curved segments 122 connected by straight segments 124.

The serpentine coin path 102 starts at the beak 108, passes through the head 120, into the neck 114, through the body 112 and into the coin reservoir 110. Coins slide and roll down the serpentine coin path 102 as illustrated by an arrow 134 and progress down the serpentine path 102 toward the coin reservoir 110. The minor slot 106 is provided for viewing a coin as it rolls and slides down the serpentine coin path 102. The minor slot 106 is centered with respect to the major slot 104 and exposes the coin as it moves along the serpentine coin path 102 when viewed from the first side 116 of the neck 114.

Figure 5:
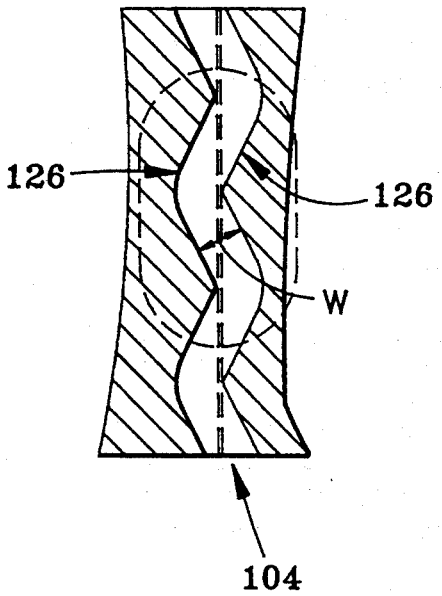
FIG. 5 is a section 5—5 of FIG. 3 illustrating the line of sight through a portion of the major slot.
Figure 6:
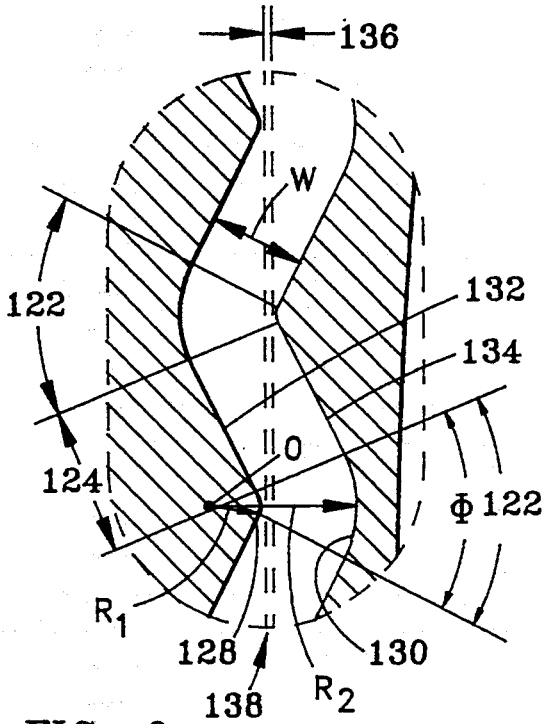
FIG. 6 is an enlarged view of the encircled section of FIG. 5 illustrating details of the geometry of the sections of the major slot illustrated in FIG. 5.

FIGS. 5 and 6 show details of the major slot 104 of the serpentine coin path 102. The major slot 104, as shown in FIG. 5, has a width W which is at least fifteen-sixteenths (15/16) of an inch to permit the passage of a quarter down the major slot 104, the width being defined as the perpendicular distance between major slot side surfaces 126. This dimension can be increased to about one (1) inch when a width w (shown in FIG. 2) for the minor slot 106 is maintained at three-eighths ($\frac{3}{8}$) of an inch. The dimension W can be further increased as the dimension w is decreased and this increase can be one-half ($\frac{1}{2}$) the decrease in w for a given w. Thus the maximum W will be:

$$W = 13/16'' - w/2.$$

While the width of the minor slot w can be decreased to an infinitesimal size, to preserve viewability of coins it is preferred that w be maintained larger than about one-eight ($\frac{1}{8}$) inch in width.

The depth D of the major slot 104 is determined by the length of the major slot side surfaces 126 which is D and is shown in FIG. 3. This dimension for D must be greater than a nickel which has a thickness of about one-sixteenth (1/16) inches and less than about one-eighth ($\frac{1}{8}$) of an inch.

The major slot 104 of the duck bank 100 can be fabricated by using a circular reamer which has a diameter W. When the reamer is directed along the centerline for the minor slot 106 (shown in FIG. 2), it will cut the major slot 104. Both the major slot 104 and the minor slot 106 are generated by the curved segments 122 and the straight segments 124 as is illustrated in FIG. 2. FIG. 6 shows in greater detail some of the parameters employed in generating the major slot 104. The curved segments 122 are generated from arcs and form part of the major slot 104 illustrated in FIG. 6. The curved segments 122 have minor arcs 128 and major arcs 130. These arcs define the curved segments 122 and are bounded by an angle $\phi$. The curves are generated by circles having radii R1 and R2 which share a common center O. The minor arcs 128 and the major arcs 130 are joined with straight line segments 132 and 134. The line segments 132 and 134 are tangent to the arcs (128, 130) and complete the major slot 104.

As the angle $\phi$ becomes smaller, reducing the size of the curved segments 122, and the straight sections formed by the straight segments 124 become longer, then for a constant width W of the major slot 104, a line of sight 136 down the major slot 104 will develop. The line of sight 136 should be less than about five-eighths ($\frac{5}{8}$) of an inch to avoid a dime from dropping down the fall line 138 of the major slot 104. As can be seen from the construction of FIG. 6, this limitation is easily maintained.

Figure 8:
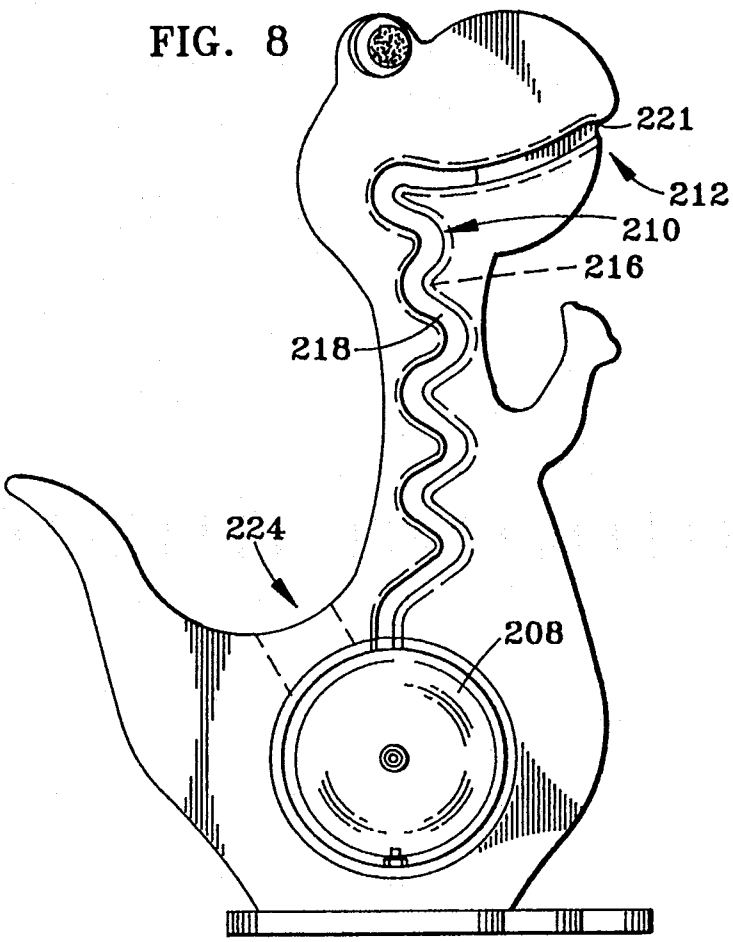
FIG. 8 is a right side view of the dinosaur of FIG. 7 showing the two minor slots.
Figure 7:
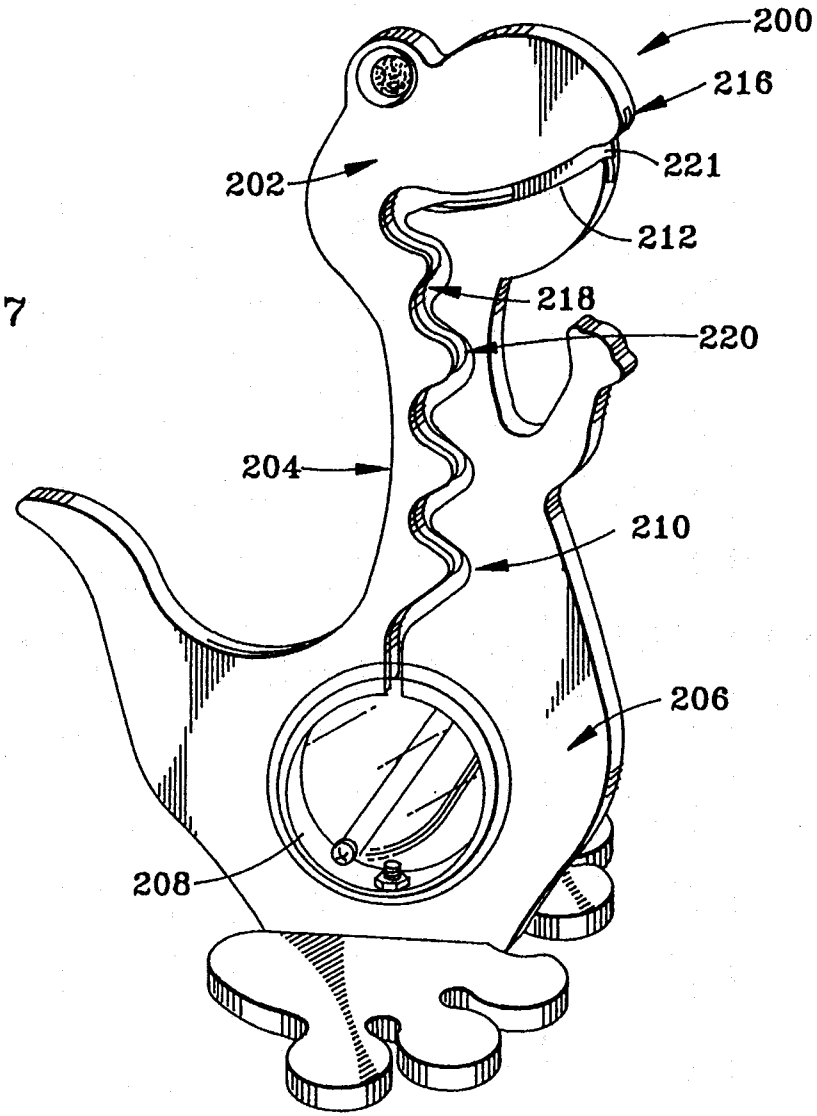
FIG. 7 is a perspective view of an embodiment of the present invention where the coin path and the coin reservoir are embedded in a dinosaur. In this embodiment there are two minor slots.
Figure 9:
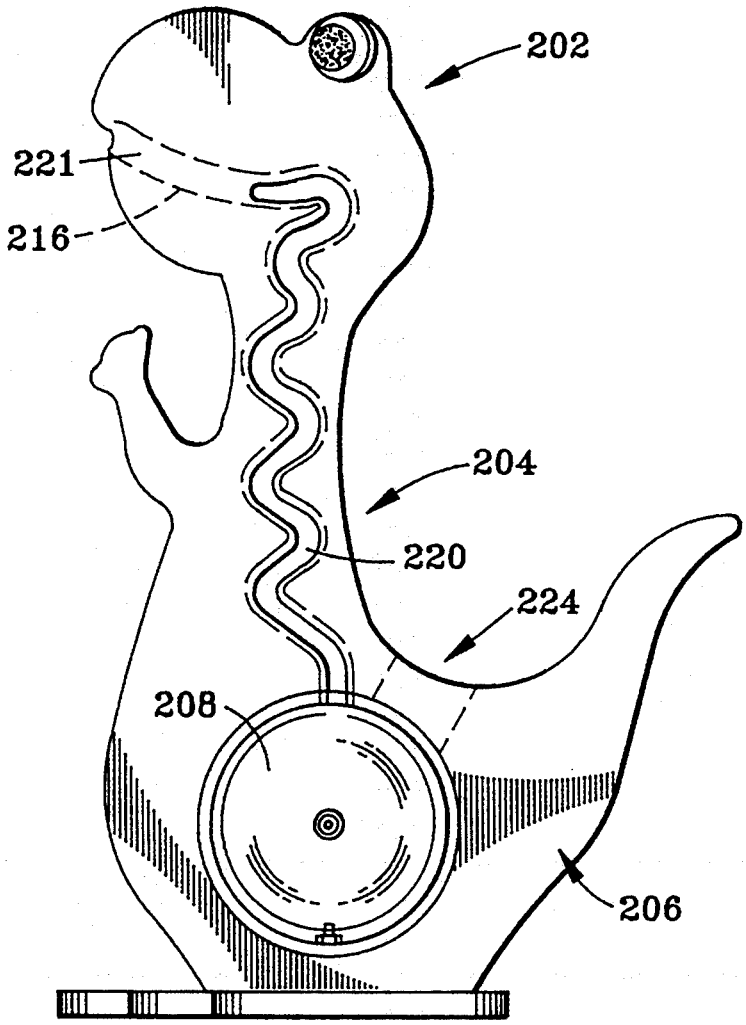
FIG. 9 is a left side view of the dinosaur of FIG. 7 showing the two minor slots.

FIGS. 7 through 9 relate to another embodiment of the present invention, wherein a housing for a bank is a dinosaur which will be referred to as a dinosaur bank 200. The dinosaur bank 200 has a head 202 which connects to a neck 204 which in turn connects to a body 206. A transparent coin reservoir 208 is incorporated into the body 206, providing an extended abdominal region for the dinosaur bank 200. A serpentine coin path 210 is terminated at one end by a mouth 212 and at the other end by the transparent coin reservoir 208. The serpentine coin path 210 for the dinosaur bank 200 has three (3) slots; a major slot 216 (best illustrated FIGS. 8 and 9) lies between a first minor slot 218 and a second minor slot 220. As can be seen in FIG. 8, both the major slot 216 and the first minor slot 218 form continuous slots between the mouth 212 of the dinosaur 200 and the coin reservoir 208. In viewing the dinosaur bank 200 from the right side as illustrated in FIGS. 7 and 8, the coin will be in view during its complete path. The second minor slot 220 has a closed section 221 of the path between the mouth 212 and the transparent coin reservoir 208; this closed section 221 of the serpentine coin path 210, when viewed from the second side of the neck 204, provides rigidity to the dinosaur bank 200.

The dinosaur bank 200 in addition to the serpentine coin path 210, has a second money path 224 which is larger than the serpentine path 210. The second money path 224 is designed to accept coins larger than a quarter (eq., half dollars, silver dollars and large foreign coins) and to accept bills. The second money path 224 should be short so that bills can be passed through the second money path 224 and deposited into the coin reservoir 208.

The serpentine coin path 210 of the dinosaur bank 200 differs from the serpentine coin path 102 of the duck bank 100. The serpentine coin path 210 of the dinosaur bank 200 illustrated in FIGS. 7 through 9, is constructed from circular arcs which when described in terms of angles $\phi$ defined in FIG. 6 are large and are connected by small line segments. Thus the configuration of the serpentine coin path 210 does not result in a line of sight down the major slot 216. A path such as illustrated in the dinosaur bank 200 will provide a more rapid back-and-forth motion to the coin and result in greater sound effects from the coin dropping through the major slot 216 than for paths with a line of sight.

Figure 10:
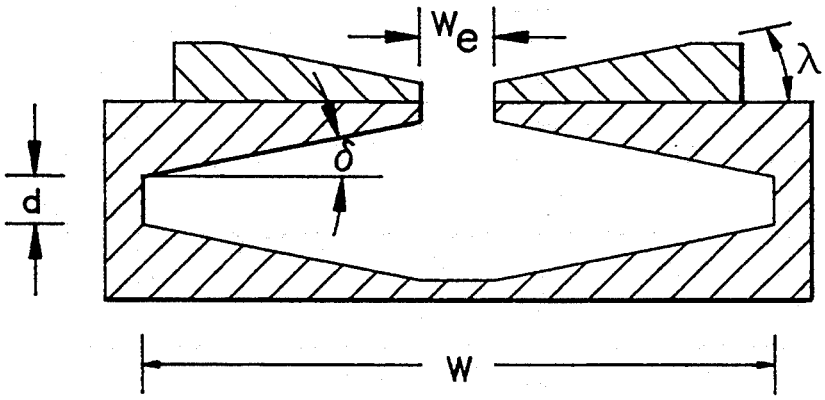
FIG. 10 illustrates a modification of the geometry of the major slot and the minor slot of the present invention. The major and minor slots employed are not truly rectangular but are felt to fall within the scope of the present invention.

While the examples set forth are illustrated with slots having a rectangular cross section, it should be appreciated that small variations in the profile of the cross sections could be made without effecting the inventive features of the present invention. FIG. 10 illustrates one variation for the minor slots. In this case, the important parameter is the width $w_e$, of the minor slot.

Similarly, the walls of the major slot may be sloped to provide draft in the event the channel is to be molded. In which case, if the width $w_e$, is reduced to about one-fourth ($\frac{1}{4}$) of an inch, the draft $\delta$ can be in the neighborhood of about 10°.

Furthermore, when the depth d of the minor slot becomes substantial, it is preferred that relief $\lambda$ be provided so that when the neck is viewed from an angle, the coin will remain in view.

What I claim is:

1. A bank having an open coin path which provides continuous viewing of a coin as it passes along the coin path comprising:

a bank body;

a substantially vertical coin path having, a major slot having a front, a back, and side surfaces, said major slot having a width W and a depth D, and a major slot centerline defining a major serpentine slot, said major serpentine slot having a line of sight less than about five-sixteenths (5/16) of an inch in width, at least one minor slot intersecting said major slot, said at least one minor slot having an open front, an open back, and side surfaces, said at least one minor slot having a width w and a depth d and a minor slot centerline defining a view path, said major slot centerline and said at least one minor slot centerline being parallel and defining a center surface parallel to said side surfaces of said major slot and said at least one minor slot, said center surface being midway between said side surfaces of said major slot and said side surfaces of said at least one minor slot, W is greater than about fifteen-sixteenths (15/16) of an inch and is less than or equal to about one and three-sixteenths (13/16) less w/2 inches, D is greater than about one-sixteenth (1/16) and less than or equal to one-eight ($\frac{1}{8}$) of an inch, w is less than about three-eights ($\frac{3}{8}$) of an inch; and a coin reservoir in said body communicating with said major slot.

2. The bank of claim 1 wherein said minor slot has a width w of greater than about one-eight ($\frac{1}{8}$) inch.

3. The bank of claim 2 wherein said bank body is in the form of an animal having a surface said animal defining said bank body and said coin reservoir defining an extended stomach of said animal.

4. The bank of claim 3 wherein said animal has a neck and wherein said major slot and said minor slot resides in part in said neck of said animal, said minor slot extending to said surface of said animal.

5. The bank of claim 3 wherein said animal is of uniform thickness T, of less than about one (1) inch.

6. The bank of claim 4 wherein said coin reservoir is transparent.

7. The bank of claim 5 wherein said coin reservoir is transparent.

8. The bank of claim 4 further comprising a second minor slot having a cross section with a width w and a depth d, and a central element defining a view path, said second minor slot extending to said surface of said animal.

9. The bank of claim 5 further comprising a second minor slot having a cross section with a width w and a depth d, and a central element defining a view path, said second minor slot extending to said surface of said animal.

10. The bank of claim 6 further comprising a second minor slot having a cross section with a width w and a depth d, and a central element defining a view path, said second minor slot extending to said surface of said animal.

11. The bank of claim 7 further comprising a second minor slot having a cross section with a width w and a depth d, and a central element defining a view path, said second minor slot extending to said surface of said animal.

12. The bank of claim 2 wherein said substantially vertical coin path has a height H of at least about 12 inches.

13. A bank having an open coin path which provides viewing of a coin as it passes along the coin path comprising:

a bank body having a surface, said bank body being in the form of an animal having a neck;

a coin path having, a major slot having a front, a back, and side surfaces, said major slot having a width W and a depth D, and a major slot centerline defining a major serpentine slot, said major serpentine slot having a line of sight less than about five-sixteenths (5/16) of an inch in width, at least one minor slot intersecting said major slot, said at least one minor slot having an open front, an open back, and side surfaces, said at least one minor slot having a width w and a depth d, and a minor slot centerline defining a view path, said major slot centerline and said minor slot centerline being parallel and defining a center surface parallel to said side surfaces of said major slot and said at least one minor slot, said center surface being midway between said side surfaces of said major slot and said side surfaces of said at least one minor slot, W is greater than about fifteen-sixteenths (15/16) of an inch and is less than or equal to about one and three-sixteenths (13/16) inch less w/2 inches, D is greater than about one-sixteenth (1/16) and less than or equal to about one-eighth ($\frac{1}{8}$) of an inch, w is greater than about one-eight ($\frac{1}{8}$) inch and less than about three-eighths ($\frac{3}{8}$) of an inch, said major slot and said at least one minor slot residing in part in said neck of said animal, said minor slot extending to said surface of said animal; and a transparent coin reservoir defining an extended stomach in said animal communicating with said major slot.

14. The bank of claim 13 further comprising a second minor slot having a cross section with a width w and a depth d, and a central element defining a viewable serpentine path, said second minor slot extending to said surface of said animal.

15. A bank having an open coin path which provides viewing of a coin as it passes along the coin path comprising:

a bank body having a surface, said bank body being in the form of an animal having a neck;

a coin path having, a major slot having a front, a back, and side surfaces, said major slot having a width W and a depth D, and a major slot centerline defining a major serpentine slot, said major serpentine slot having a line of sight less than about five-sixteenths (5/16) of an inch in width, a first minor slot intersecting said major slot, said first minor slot having an open front, an open back, and side surfaces, said first minor slot having a width w and a depth d, and a minor slot centerline defining a view path, a second minor slot intersecting said major slot, said second minor slot having an open front, an open back, and side surfaces, said second minor slot having a width w and a depth d, and a minor slot centerline defining a view path, said major slot centerline and said minor slot centerlines being parallel and defining a center surface parallel to said side surfaces of said major slot and said minor slots, said center surface being midway between said side surfaces of said major slot and said side surfaces of said minor slots, W is greater than about fifteen-sixteenths (15/16) of an inch and is less than or equal to about one and three-sixteenths (13/16) inch less w/2 inches, D is greater than about one-sixteenth (1/16) and less than or equal to about one-eighth ($\frac{1}{8}$) of an inch, w is greater than about one-eight ($\frac{1}{8}$) inch and less than about three-eighths ($\frac{3}{8}$) of an inch, said major slot and said minor slots residing in part in said neck of said animal, said minor slots extending to said surface of said animal; and a coin reservoir defining an extended stomach in said animal communicating with said major slot.

16. A bank having an open coin path which provides viewing of a coin as it passes along the coin path comprising:

a bank body having a surface, said bank body being in the form of an animal said animal having a uniform thickness T of less than about one (1) inch;

a coin path having, a major slot having a front, a back, and side surfaces, said major slot having a width W and a depth D, and a major slot centerline defining a major serpentine slot, said major serpentine slot having a line of sight less than about five-sixteenths (5/16) of an inch in width, at least one minor slot intersecting said major slot, said at least one minor slot having an open front, an open back, and side surfaces, said at least one minor slot having a width w and a depth d, and a minor slot centerline defining a view path, said major slot centerline and said minor slot centerline being parallel and defining a center surface parallel to said side surfaces of said major slot and said at least one minor slot said center surface being midway between said side surfaces of said major slot and said side surfaces of said at least one minor slot, W is greater than about fifteen-sixteenths (15/16) of an inch and is less than or equal to about one and three-sixteenths (13/16) inch less w/2 inches, D is greater than about one-sixteenth (1/16) and less than or equal to about one-eighth ($\frac{1}{8}$) of an inch, w is greater than about one-eight ($\frac{1}{8}$) inch and less than about three-eighths ($\frac{3}{8}$) of an inch; and a coin reservoir defining an extended stomach in said animal communicating with said major slot.

17. The bank of claim 16 wherein said coin reservoir is transparent.

18. The bank of claim 16 further comprising a second minor slot having a cross section with a width w and a depth d, and a central element defining a viewable serpentine path, said second minor slot extending to said surface of said animal.

19. The bank of claim 17 further comprising a second minor slot having a cross section with a width w and a depth d, and a central element defining a viewable serpentine path, said second minor slot extending to said surface of said animal.

20. A bank having an open coin path which provides continuous viewing of a coin as it passes along the coin path comprising:

a bank body;

a coin path having, a major slot having a front, a back, and side surfaces, said major slot having a width W and a depth D, and a major slot centerline defining a major serpentine slot, said major serpentine slot having a line of sight less than about five-sixteenths (5/16) of an inch in width, at least one minor slot intersecting said major slot, said at least one minor slot having an open front, an open back, and side surfaces, said at least one minor slot having a width w and a depth d and a minor slot centerline defining a view path said minor slot having a length at least about eighty percent (80%) of said major slot, said major slot centerline and said at least one minor slot centerline being parallel and defining a center surface parallel to said side surfaces of said major slot and said at least one minor slot, said center surface being midway between said side surfaces of said major slot and said side surfaces of said at least one minor slot, W is greater than about fifteen-sixteenths (15/16) of an inch and is less than or equal to about one and three-sixteenths (13/16) less w/2 inches, D is greater than about one-sixteenth (1/16) and less than or equal to one-eight ($\frac{1}{8}$) of an inch, w is less than about three-eights ($\frac{3}{8}$) of an inch; and a coin reservoir in said body communicating with said major slot.

21. The bank of claim 20 wherein said minor slot has a width w of greater than about one-eight ($\frac{1}{8}$) inch.

22. The bank of claim 21 wherein said bank body is in the form of an animal having a surface said animal defining said bank body and said coin reservoir defining an extended stomach of said animal.

23. The bank of claim 22 wherein said animal has a neck and wherein said major slot and said minor slot resides in part in said neck of said animal, said minor slot extending to said surface of said animal.

24. The bank of claim 22 wherein said animal is of uniform thickness T, of less than about one (1) inch.

25. The bank of claim 22 wherein said coin reservoir is transparent.

26. The bank of claim 24 wherein said coin reservoir is transparent.

27. The bank of claim 23 further comprising a second minor slot having a cross section with a width w and a depth d, and a central element defining a view path, said second minor slot extending to said surface of said animal.

28. The bank of claim 24 further comprising a second minor slot having a cross section with a width w and a depth d, and a central element defining a view path, said second minor slot extending to said surface of said animal.

29. The bank of claim 25 further comprising a second minor slot having a cross section with a width w and a depth d, and a central element defining a view path, said second minor slot extending to said surface of said animal.

30. The bank of claim 26 further comprising a second minor slot having a cross section with a width w and a depth d, and a central element defining a view path, said second minor slot extending to said surface of said animal.

* * * * *

UNITED STATES PATENT AND TRADEMARK OFFICE

CERTIFICATE OF CORRECTION

PATENT NO. : 5,437,408

DATED : August 01, 1995

INVENTOR(S) : John M. Chesnut

It is certified that error appears in the above-identified patent and that said Letters Patent is hereby corrected as shown below:

IN THE ABSTRACT OF DISCLOSURE

Line 1 after "has a", delete "visible" and substitute --viewable-- therefor.

IN THE SPECIFICATION

Column 2, line 7 before "entire", delete "its" and substitute --their-- therefore.

Column 3, line 13 delete "(13/16 - w/2)" and substitute --(1 3/16 - w/2)-- therefor;
line 15 after "about", delete "one-eights (1/80" and substitute --one-eighth (1/8)-- therefore;
line 18 after "slot", insert --,--.

Column 5, line 50 before "inches", delete "(13/16 - w/2)" and substitute --(1 3/16 - w/2)-- therefor.

Column 6, line 14 before "the body", delete "loins" and substitute --joins-- therefor;
line 14 after "also", delete "loins" and substitute --joins-- therefor;
line 65 delete "W = 13/16" - w/2." and substitute --W = 1 3/16" - w/2.-- therefor.

Column 7, line 2 before "(1/8) inch", delete "one-eight" and substitute --one-eighth-- therefore.

IN THE CLAIMS

Column 8, line 59 after "three-sixteenths", delete "(13/16)" and substitute --(1 3/16)-- therefor;
line 61 after "equal to", delete "one-eight" and substitute --one-eighth-- therefor;
line 62 after "about", delete "three-eights" and substitute --three-eighths-- therefor;
line 66 after "about", delete "one-eight" and substitute --one-eighth-- therefor;
line 68 after "surface", insert --,--.

UNITED STATES PATENT AND TRADEMARK OFFICE

CERTIFICATE OF CORRECTION

PATENT NO. : 5,437,408

DATED : August 01, 1995

INVENTOR(S) : John M. Chesnut

It is certified that error appears in the above-identified patent and that said Letters Patent is hereby corrected as shown below:

Column 9, line 4 after "minor slot", delete "resides" and substitute --reside-- therefor;
line 63 after "three-sixteenths", delete "(13/16)" and substitute --(1 3/16)-- therefor;
line 67 after "about", delete "one-eight" and substitute --one-eighth-- therefor.

Column 10, line 45 after "three-sixteenths", delete "(13/16)" and substitute --(1 3/16)-- therefor;
line 49 after "about", delete "one-eight" and substitute --one-eighth-- therefor.

Column 11, line 15 after "three-sixteenths", delete "(13/16)" and substitute --(1 3/16)-- therefor;
line 19 after "about", delete "one-eight" and substitute --one-eighth-- therefor.

Column 12, line 10 after "three-sixteenths", delete "(13/16)" and substitute --(1 3/16)-- therefor;
line 12 after "equal to", delete "one-eight" and substitute --one-eighth-- therefor;
line 13 after "about", delete "three-eights" and substitute --three-eighths-- therefor;
line 17 after "about", delete "one-eight" and substitute --one-eighth-- therefor;
line 24 before "in part", delete "resides" and substitute --reside-- therefor.

Signed and Sealed this

Thirtieth Day of December, 1997

*Attest:*

*Attesting Officer*

Bruce Lehman

BRUCE LEHMAN

*Commissioner of Patents and Trademarks*